US009920533B2

(12) United States Patent
Johnsen

(10) Patent No.: US 9,920,533 B2
(45) Date of Patent: Mar. 20, 2018

(54) DRAIN

(71) Applicant: Asle Johnsen, Vear (NO)

(72) Inventor: Asle Johnsen, Vear (NO)

(73) Assignee: AIWELL HOLDING AS, Vear (NO)

( * ) Notice: Subject to any disclaimer, the term of this patent is extended or adjusted under 35 U.S.C. 154(b) by 0 days.

(21) Appl. No.: 14/901,657

(22) PCT Filed: Jun. 27, 2014

(86) PCT No.: PCT/NO2014/050118
§ 371 (c)(1),
(2) Date: Dec. 28, 2015

(87) PCT Pub. No.: WO2014/209133
PCT Pub. Date: Dec. 31, 2014

(65) Prior Publication Data

US 2016/0153195 A1 Jun. 2, 2016

(30) Foreign Application Priority Data

Jun. 28, 2013 (NO) ..... 20130895

(51) Int. Cl.
*E04D 13/04* (2006.01)
*E03F 5/04* (2006.01)

(52) U.S. Cl.
CPC .. *E04D 13/0409* (2013.01); *E04D 2013/0413* (2013.01); *E04D 2013/0418* (2013.01); *E04D 2013/0427* (2013.01)

(58) Field of Classification Search
CPC ..... E04D 13/0409; E04D 2013/0427; E04D 2013/0418; E04D 2013/0422;
(Continued)

(56) References Cited

U.S. PATENT DOCUMENTS 1,791,512 A 2/1931 Schurman
4,486,906 A * 12/1984 Meier ..... E03D 1/142 4/378
(Continued)

FOREIGN PATENT DOCUMENTS

CN 2621200 Y 6/2004
CN 101517174 A 8/2009
(Continued)

OTHER PUBLICATIONS

English language Abstract of EP 1607542 A1.
(Continued)

*Primary Examiner* — Christine T Cajilig
(74) *Attorney, Agent, or Firm* — Hershkovitz & Associates, PLLC; Abe Hershkovitz

(57) ABSTRACT

The present invention is to provide a system and a method for effectively preventing that gases/heat from an outlet are ascending from a gully and form ice, in addition to effectively drain liquids through a gully. The present invention is obtained by arranging a float so that said float and a portion of the gully define a closable opening for through flow, further arranged such that the float is preventing gases/heat from the outlet to ascend up from the gully and form ice and/or so that the float prevents that gas is drawn into the gully.

13 Claims, 6 Drawing Sheets

(58) Field of Classification Search
CPC .. E04D 2013/0853; E03F 5/0411; E03F 5/04; E03F 2005/068
See application file for complete search history.

(56) References Cited

U.S. PATENT DOCUMENTS

| | | | | |
|---|---|---|---|---|
| 4,683,685 | A * | 8/1987 | Ebeling | E04D 13/0409 210/163 |
| 5,469,670 | A | 11/1995 | Thaler | |
| 6,318,397 | B1 * | 11/2001 | Huber | E03F 5/0407 137/15.19 |
| 8,668,105 | B2 * | 3/2014 | Al-Subaiey | B65D 88/38 137/172 |

FOREIGN PATENT DOCUMENTS

| | | | | |
|---|---|---|---|---|
| DE | 3737767 | A1 | 5/1989 | |
| DE | 20115386 | U1 | 12/2001 | |
| DK | 128021 | B | 2/1974 | |
| EP | 1203851 | A1 | 5/2002 | |
| EP | 1607542 | A1 | 12/2005 | |
| GB | 1375105 | A * | 11/1974 | E04D 13/0409 |
| GB | 2269402 | A * | 2/1994 | E04D 13/0409 |
| NO | 130697 | B | 10/1974 | |
| NO | 152020 | B | 4/1985 | |
| NO | 175912 | B | 9/1994 | |
| RU | 2458219 | C1 | 8/2012 | |
| WO | WO 1983/03114 | A1 | 9/1983 | |
| WO | WO 2010/128283 | A2 | 11/2010 | |

OTHER PUBLICATIONS

English language Abstract of DE 3737767 A1.
English language translation of description and claims of DE 20115386 U1.
English language Abstract of EP 1203851 A1.
English language Abstract of WO 9401637 A1.
International Search Report dated Sep. 25, 2014.
Written Opinion of the International Search Authority dated Sep. 25, 2014.
English language translation of description of CN 2621200 Y.
English language translation of description of CN 101517174 A.
Office Action dated Nov. 22, 2016 in the related Chinese Patent Application No. 201480045468.0 (Publication No. CN105473799 A).
English language translation of Office Action dated Nov. 22, 2016 in the related Chinese Patent Application No. 201480045468.0 (Publication No. CN105473799 A).
Extended European Search Report dated Apr. 6, 2017 in corresponding European Patent Application No. 14817536.7.

* cited by examiner

Fig.1 - Prior Art
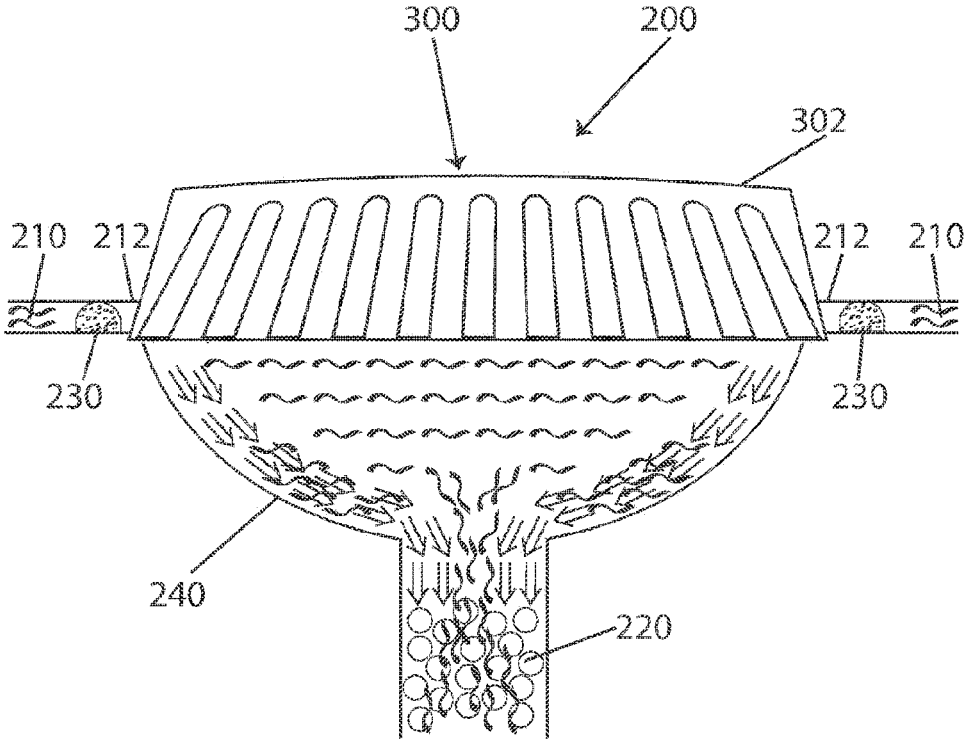
Fig.2 - Prior Art
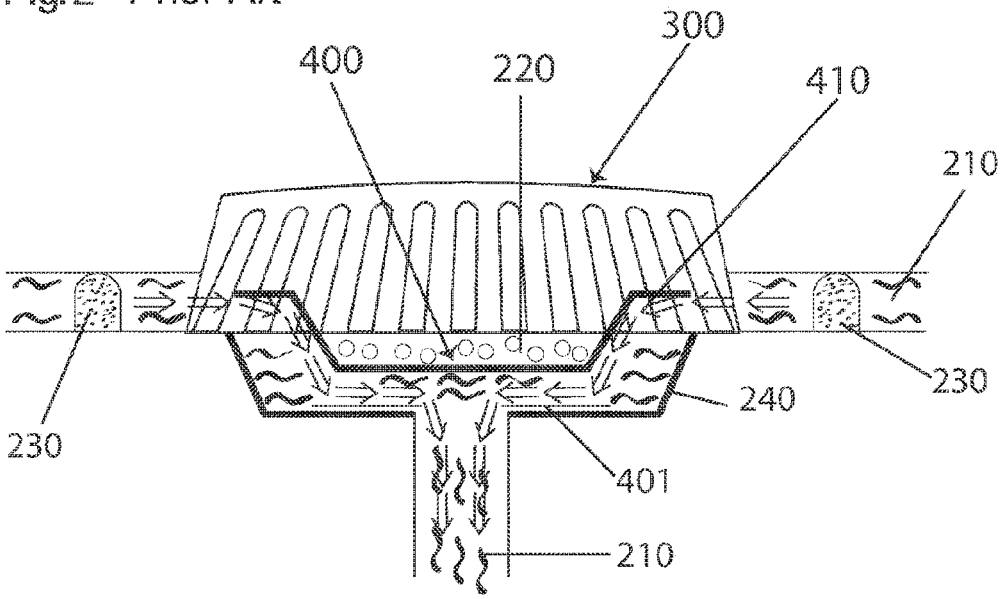

Fig 3 - Prior Art
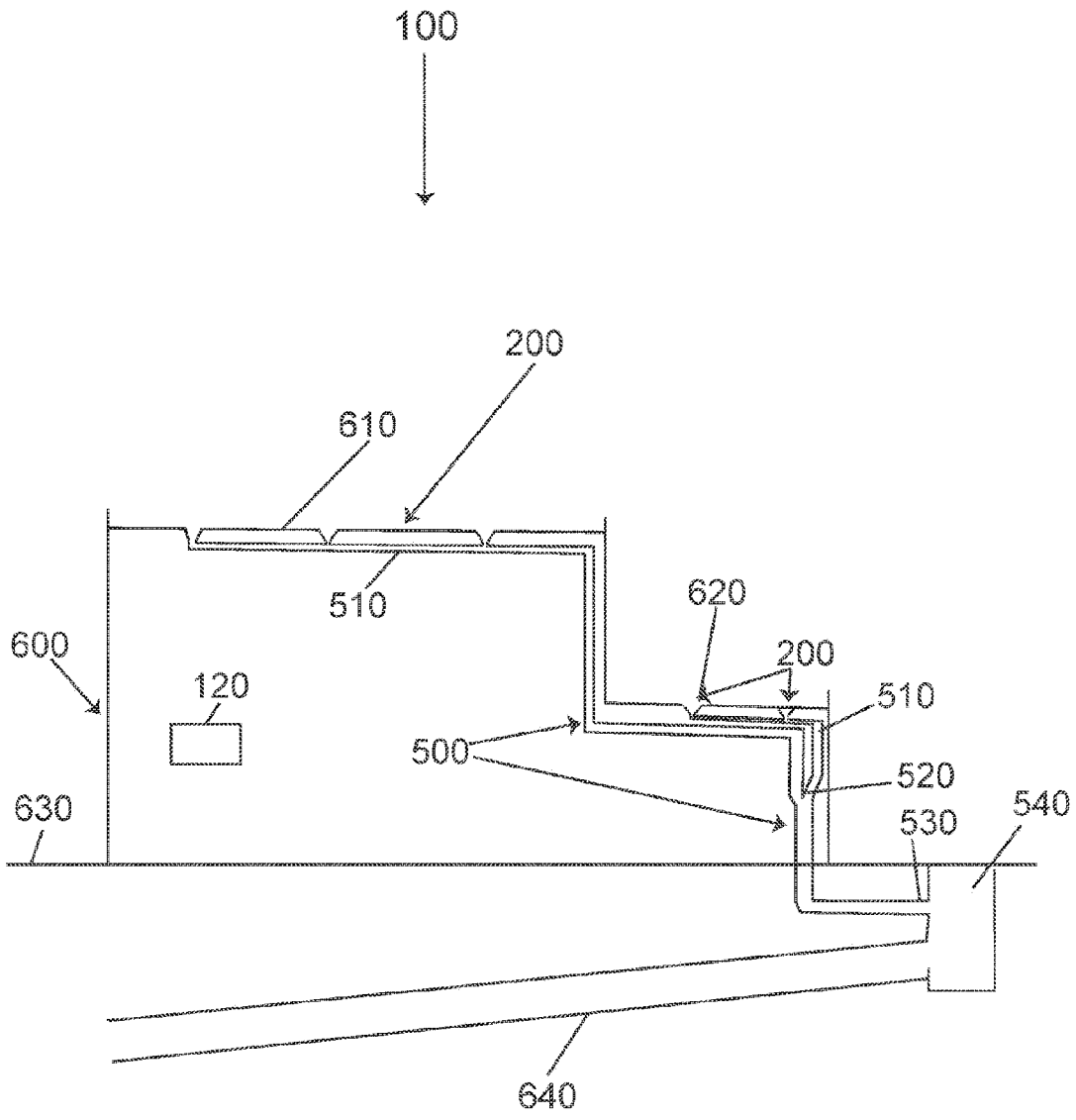

DRAIN

TECHNICAL FIELD

The invention relates to drains and gullies in general, and in particular, to a system and a method for effectively draining liquids through a gully.

BACKGROUND OF THE INVENTION

Generally, open gullies are known, from gullies on roofs or in roads as well as in wash and laundry drains and sinks. The basic principle is that liquid flows due to its own weight by "gravity flow," and these gullies can be called self-draining. These gullies are open and allow air to enter the outlet or drainage system, thereby limiting the amount of liquid to be drained. In addition, the employment of a manifold may hinder liquid flowing from a gully at a higher level through a lower gully.

FIG. 1 of the drawings shows a system of the gravity flow gully type which is, due to the above mentioned reason, preferably avoids use of a manifold. These types of gullies have their own outlets which are gathered in bottom pipes and are fed to a basin or direct to the drainage or sewer pipeline network.

A prior art referred to as NO Application No. 17591 of the same inventor discusses a gully having elongated channel parts extending radially from a central part.

There are also vacuum gullies, also called total flow gullies, where gases like air are excluded from the flow. The technical effect of this is that a liquid column is established from the gully to the outlet, the complete weight of said column generating a heavy suction to handle lager amounts of water than open gullies. In addition, this enables the use of manifolds so as to save pipes and simplify portions of the structure. Such systems are often called "full-bore flow" or "syphonic" (or "siphonic"). There are, however, a number of problems connected to such gullies.

- The gully head is more complex, as the head comprises a housing part having a roof and forms an air lock, the roof defining the maximum height for the opening into the housing part.
- The gully may include a throttle or choke disk, often in the form of a ring or a plate having a hole, arranged in the gully bottom and limiting/throttling the outlet dimension.
- Several throttle disks of various dimensions have to be produced.
- The gully head is easily blocked by extraneous matter like leaves, and dirt and smaller particles that gather together to form a kind of clay.
- The system is complicated to calculate and dimension.
- The system is, when installed, sensitive to even minor changes, like new superstructures or the adjustments of outlet pipes or constructional alterations, leading to changes in the amount of water between the gullies. Then, new calculations and adjustments for new throttle disks or gully dimensions have to be made, and then such disks and gullies must be constructed.
- Gullies have mainly been arranged in the same heights, and if gullies in different floors of a building are to be connected together, the dimensioning has to be calculated and the connection has to be carried out further down to the outlet.
- The gullies can be adapted to different amounts of water by use of throttle disks, but only to a limit.

- If the amounts of water are too small, the outlet pipes will no longer be self-cleaning, so that the outlets over the time may become fouled/clogged unless regularly flushed.

FIG. 2 shows a system with a vacuum gully. It should be mentioned that the outlet system for such gullies comprises pipes arranged horizontally, that is, without any inclination. Because the outlet pipes in this case can be arranged horizontally (without inclination), these pipes are accommodated just under the ceiling, and are assembled to turn down at only one point in their connections. Due to this, the pipe arrangement in the ground will be at a minimum, which is particularly favorable when the building is on a rock fundament.

In a first period, a vacuum gully will operate like a gravity flow gully, and only when the water level rises over the roof height of the inlet, gas will be expelled so the gully starts operating as a vacuum gully. The draining ability increases dramatically and is maintained until the water level has been reduced so far that also air (a gas) is drawn in, whereby the gully again changes to operate as a gravity flow gully. A vacuum gully having a 75 mm diameter can, as an example, handle 10 liters per second at a water level of 35 mm, and 19 liters per second at a water level of 55 mm.

When several vacuum gullies are connected together, the air intake from one gully will be sufficient for that liquid column to no longer be unbroken, so that all the gullies start to operate as gravity flow gullies. This can be remedied by using throttle disks so that the gullies, during operation, will be drained approximately at the same time, so that the complete system may operate as a vacuum gully for as long as possible.

Vacuum gullies can have an opening of 11 mm between surface and roof, but without a throttle disk. Also, vacuum gullies can be used with an opening of 19 mm and have throttle disks. A lower opening means that the gully operates as a vacuum gully even with a lower water level, but has the drawback that the resistance against flowing through also becomes higher.

Common for gullies of the gravity flow and vacuum gullies is that warm air rising from the outlet causes ice build-up on the roof surface. This happens because the gully remains at temperatures above the freezing point while the snow on the roof is holding temperatures below freezing. Ice will then build up in the area around zero degrees (0° C.). The build-up of ice will normally become greater for gravity-flow gullies due to the employment of greater outlet pipes that normally dissipate more heat and therefore melt more slow, which leads to the build-up of more ice.

The heat is generated by at least portions of the outlet pipes are in frost-free ground, and is brought up through building constructions having higher temperature. Warm air therefore ascends from the outlets and heats up the gullies in varying degrees, but common for all the gullies is that they receive a surplus heat, keeping them free from frost so that they are not frozen completely. This is a great benefit for the gullies themselves, as the entire outlet would become blocked if the gullies are frozen. The drawback is that the surplus heat also melts the snow around the gully so that the melted water can build up ice blocks around the gully on the roof surface.

BRIEF SUMMARY OF THE INVENTION

For these reasons, it is a main object of the present invention to provide a system and a method for effectively hindering gases/heat from the outlet that ascends from the gully and generates ice, in addition to the draining of liquids through a gully where the above mentioned problems are overcome.

BRIEF DESCRIPTION OF THE DRAWINGS

The invention will be further described below and refer to the drawings presenting several exemplary embodiments, in which:

FIG. 1 shows state of the art of an open gully;

FIG. 2 shows a vacuum gully of prior art;

FIG. 3 shows an outlet system for vacuum gullies;

Figure 4A:
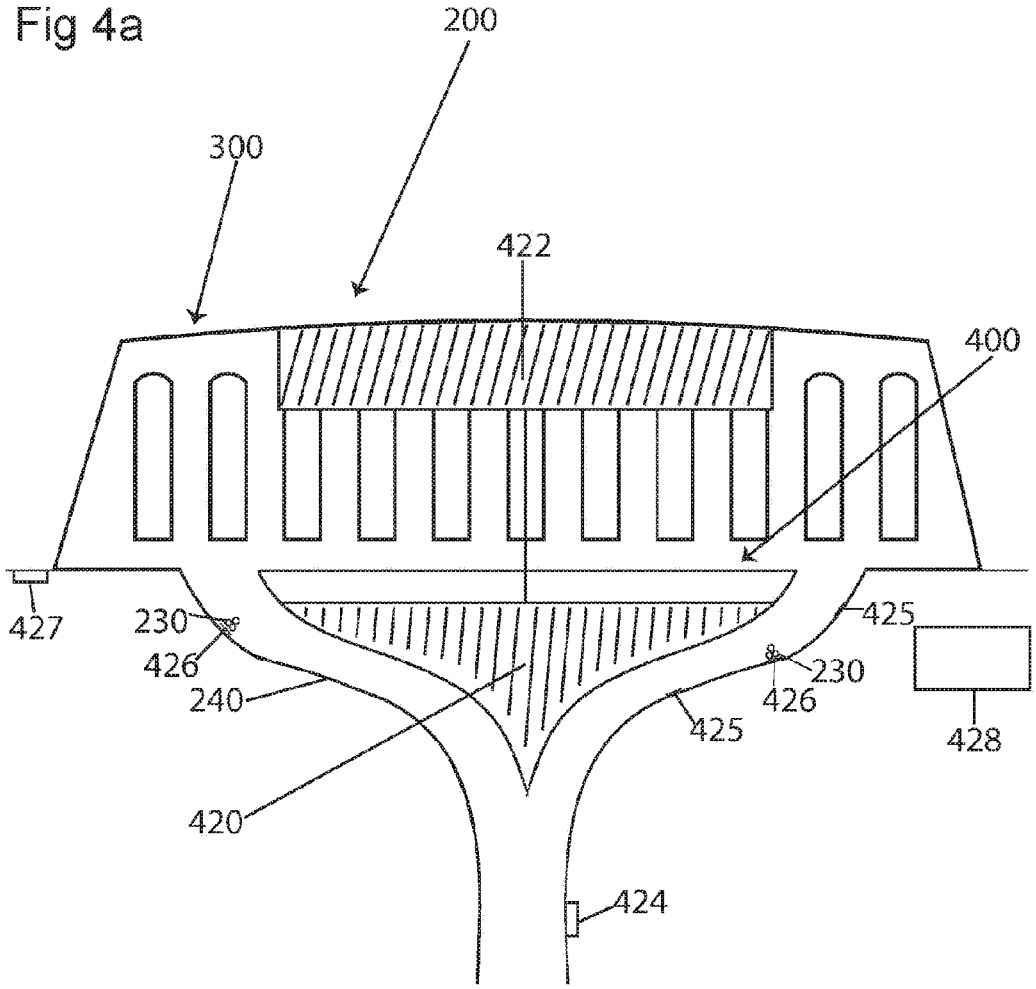
FIG. 4*a* shows a section of a gully according to one embodiment of the present invention.

The reference numbers used in the drawings are as follows;

100 Drain or gully system;
120 Central control unit;
200 Gully;
210 Liquid;
212 Liquid level of gully;
220 Gas bubble;
230 Ice;
240 Gully bottom;
300 Housing part;
302 Roof of housing part;
400 Gully head;
401 Throttle or choke disk;
410 Prior art roof;
420 Float;
422 Actuator for float;
424 Pressure sensor;
425 Temperature sensor;
426 Heating element;
427 Pressure gauge (under pressure);
428 Control unit;
440 Insert;
442 Goose neck;
450 Float;
460 Float control;
462 Dowel (guide) pin;
464 Guide cylinder;
500 Outlet or drainage system;
510 Drain pipe from gully;
512 Annulus;
520 Manifold;
525 Main down pipe;
530 Outlet;
540 Basin;
600 Building;
610 Roof;
620 Terrace;
630 Ground level;
640 External drainage or outlet system;
700 Gully grid;
702 Roof of gully grid; and
704 Arms for gully grid.

DETAILED DESCRIPTION OF EMBODIMENTS OF THE INVENTION

The present invention achieves the objects discussed above by a gully system (gully device) comprising a gully (200) for draining a liquid (210) to a drainage system (500), having the features of a float (420, 450) arranged so that the float and a portion of the gully (200) define a closable opening for through flow, and arranged so that the float (420, 450) prevents gas/heat from an outlet rising up from the gully (200) and forming ice (230).

The present invention also achieves the objects discussed above by a gully system comprising a gully (200) for draining of a liquid (210) to a drainage system (500), having the features of a float (420, 450) arranged so that said float and a portion of the gully (200) define a closable opening for the through flow, and arranged so that the float (420, 450) prevents gas (220) from being drawn into the gully (200).

The present invention further achieves the objects discussed above by a method for controlling a gully system (100) according to the above systems, and further comprising an actuator (422). The method includes the steps for adjustment of controlling the actuator (422) for lifting the float (420/450) until gas is drawn into the gully (200), and controlling the actuator (422) to lower the float (420/450) until gas is no longer drawn into the gully (200).

The present invention additionally achieves the objects discussed above by a method for flushing gullies, and further comprising an actuator (422) for flushing. The method includes the steps for adjustment of controlling the actuator (422) to close by using the float (420/450) until the liquid level above the gully (200) has reached a critical height, and adjusting the actuator (422) to open by using the float so that the draining system is filled with liquid.

The present invention also achieves the objects discussed above by a gully grid (700) for gullies, comprising a roof (702) in the gully grid, and further comprising at least one arm (704) extending outwardly and down from the roof (702).

The present invention is directed to, among other components, an adjustable float in a gully.

In a first aspect of the invention, the float is adjusted to prevent gases/heat from the outlet from rising from the gully and forming ice.

In a second aspect of the invention, the float is adjusted to prevent gas, typically air, from becoming sucked into the gully and stopping the vacuum gully effect.

Both aspects can be combined, but the first aspect is only relevant where building-up of ice is a problem. Common for both is that it is desired to prevent gas/air from passing into or out from the gully by an adjustable float that can be adjusted to block the down pipe from the gully. The combination also can be made by using a float adapted for performing both tasks, as well as two floats in tandem used in the same gully, as a first float prevents gas from being sucked into the gully, while a second float prevents gas from ascending from the gully and forming ice. In the first aspect, the adjustment is sufficiently taken care of by using a float having low specific weight so that it floats up when liquid enters the gully. Such a system does not need further operating or control systems.

In the second aspect, it is desirable to have sensors for initial adjustment of the float as well as adjustment during operation. This can be done by providing gullies with local pressure gauges, by providing the outlet system with a central pressure gauge and a central control unit, or in other ways to measure operating parameters.

The invention is a novel gully arranged locally or centrally and having sensors measuring, e.g., pressure, temperature, water level, and a float acting both as an automatic adjustable air lock and as an adjustable throttle or choke disk. The float is preferably controlled/regulated by an automatic unit.

As the float according to the present invention provides several technical effects connected to the build-up of ice and draining, where these are related to draining for surfaces, these are comprised by same inventive concept.

The technical difference from traditional gullies or drains in the first aspect is that the float reduces the heat supply from the outlet pipe and out from the gully. This involves moving the zero point from the roof surface and down into the gully, preferably just above the float, so that it is not in a position where it will freeze.

In a favorable embodiment, the gully is provided with a heating element so that the zero point can be adjusted upwardly.

The technical difference from a vacuum gully is that the roof in the housing part is replaced by a float defining an adjustable opening for liquid flowing into the gully and down in the outlet.

These effects provide in turn further favorable effects:

- the use of throttle disks are avoided, as the adjustable float replaces these and an effective throttle disk is defined by the adjustable float;
- the problem of blocking is overcome, as possible extraneous elements or matter are/is removed by raising the gully head and the float sufficiently, so that when extraneous elements are removed, the gully head and the float can be lowered back to the original position;
- calculations are greatly simplified, as the float is adjustable and controlled by local conditions;
- by alterations, the working situation will be adjusted for compensation by adjustment of the float;
- gullies or drains in several heights can be connected together to a common draining or outlet system as the roof surface is separately adjusted by lowering and raising the floats, under the condition that the connections to the main outlet are made correctly by giving each roof its own gravity fall height before the connection;
- due to the float being held in a closed position until there is a demand for draining, the present invention is able to avoid a warm air flow ascending from the outlet and facilitating the building-up of ice, and as well, the amount of air-carried extraneous matter such as sand and dust are reduced from entering into the outlet system; and
- the roof can be simply pressure tested with a greater water level before delivery to the builder, and the height of the water level can be logged at each gully as well as the time the roof has had this water level. This again may be used as documentation for the owner as a confirmation on that the test is carried out with noted time, date and clock hour. A pressure test can be repeated just ahead of the expiration of the warranty in order to check if the roof still is tight.

Calculations are made for giving approximately the same under pressure in all the gullies.

The control unit measures the pressure in all the gullies and adjusts its separate floats so that the same under pressure is obtained for the complete plant.

The described solution can be employed for all types of outlet and draining systems, but for systems of the gravity flow gullies, a simpler solution can be used.

Figure 5A:
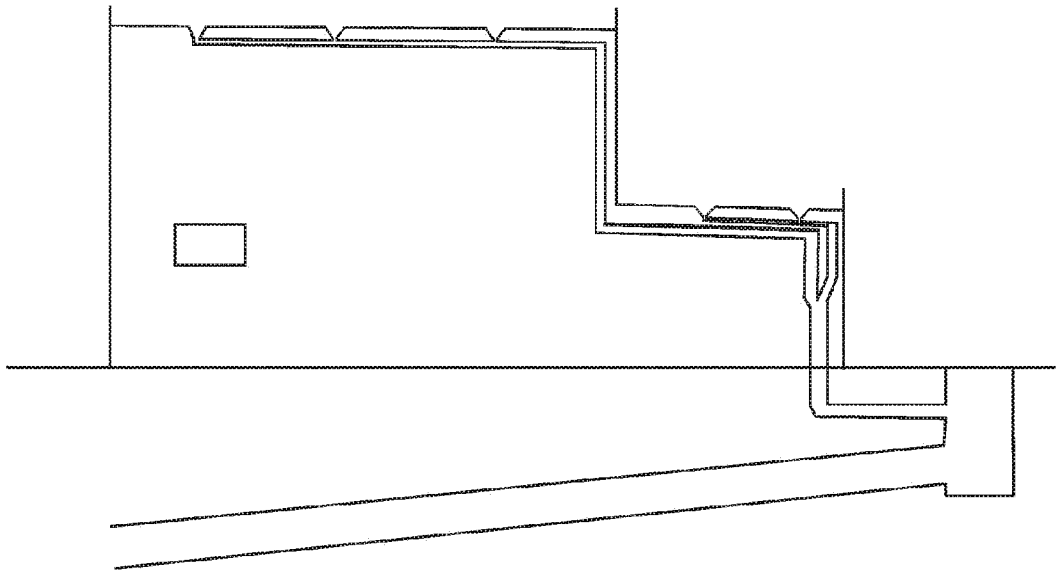
FIG. 5*a* shows an outlet system for a gully according to one embodiment of the present invention having a vacuum gully.
Figure 5B:
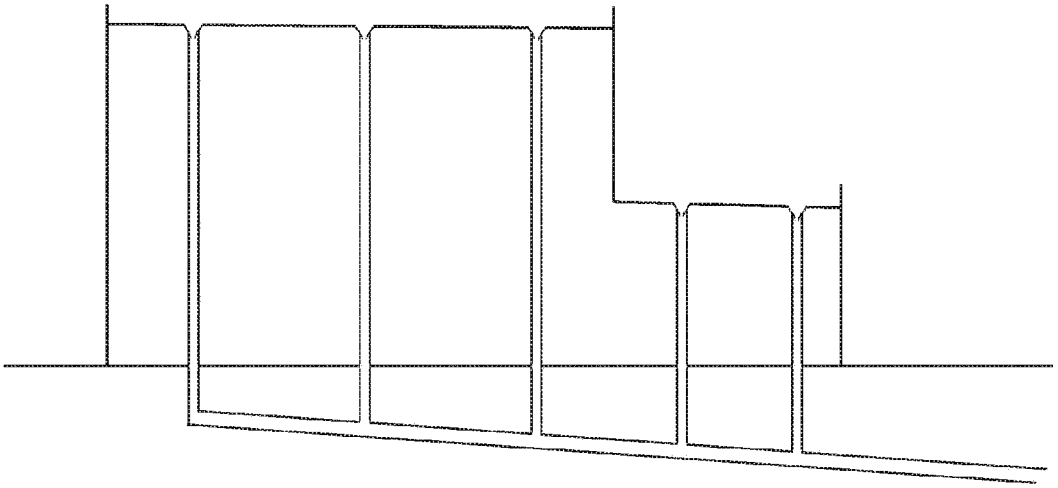
FIG. 5*b* shows an outlet system for a gully according to one embodiment of the present invention having a gravity flow gully.

The invention will be described in more details with references to the drawings showing several embodiments, in that FIG. 1 schematically shows a open gully 200 of prior art and arranged on a roof 610 of a building 600, shown in FIG. 3 and FIG. 5*b*. The gully leads a liquid 210, typically water, to a drainage (outlet) system 500 through a drain pipe 510 from the gully. The drainage system comprises an outlet to an external draining or outlet system 640, such as a municipal draining system beneath ground level 630.

During operation, water will enter the gully and bring gas, typically air, with it, in the form of bubbles 220. This results in that the water is not in the form of a single column of water. A major part of the fluid flow cross section is of air, and the capacity thereby is correspondingly reduced.

If an additional gully is arranged on a terrace 620 at a level beneath the roof and is connected to a common outlet system, the risk is that, during heavy precipitations, water from the roof will flow up through the outlet system and out through the gully on the terrace.

FIG. 2 shows schematically a vacuum gully according to prior art, and comprises, in addition to the solution mentioned above, a housing part 300 having a roof 302 and a grid to avoid the entering of extraneous matter and to protect components in the housing part, and also a gully head 400. The gully head comprises a roof 410 that, together with the bottom 240 of the gully, defines an opening for through flow. The diameter and height of the opening as well as the complete outlet system and its diameter have to be calculated before installation.

During operation at a low water flow, the vacuum gully will act approximately as an open gully, but when the inflow exceeds a certain level so that the roof is submerged in water, air will no longer enter the gully, but just water enter into the outlet system, so there will exist an unbroken column of water from the gully to the outlet.

The weight of the column establishes a strong suction that effectively drains large amounts of water from the roof, and at the same time the complete column cross section is water, even if a manifold 520 to connect several gullies together to a common outlet. FIG. 3 and FIG. 5*a* show schematically such an outlet system for vacuum gullies.

The connection to open gullies or gullies at several levels will allow for gas in the column and then destroy the effect.

The roof can include a separate throttle disk 401 adapted for allowing large water through-put without also letting air enter. Throttle disks are typically provided in several sizes, and the choice of a throttle or choke disk will be a result from the calculations made when the complete plant is projected.

Figure 4B:
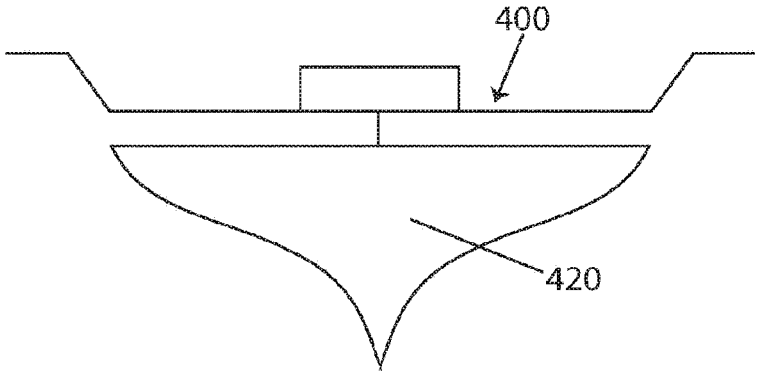
FIG. 4*b* shows a section of a gully according to one embodiment of the present invention, in detail.

FIGS. 4*a* and 4*b* show schematically a section of a gully according to the present invention, and comprise a float 420 that together with the gully bottom defines an opening for a through flow. The height is adjustable by the actuator 422 for the float, where the actuator is controlled by a control unit 428 receiving signals from a pressure sensor 424 arranged in the gully downstream from the float.

Figure 6:
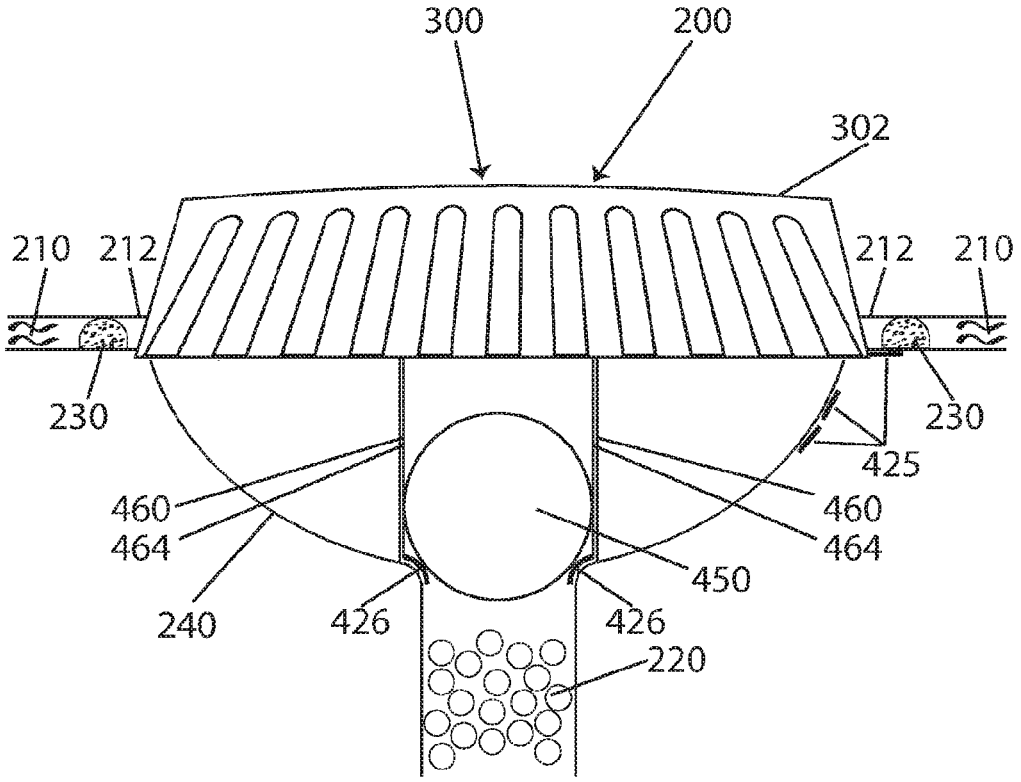
FIG. 6 shows an outlet gully having a float, only for a gravity flow gully.

In a first aspect where the float 420 prevents heat from the outlet from rising up from the gully and forming ice, the float is in a closed position when there is no need for draining. When liquid 210 builds up, it flows into the gully and the float is lifted to allow the liquid in the gully to flow further down into an outlet pipe connected to the gully. In a simple embodiment, the float is a ball 450, see FIG. 6, and the ball is floating on the water due to its buoyancy. The ball is preferably arranged to be movable in a perforated tube or in a guide cylinder 464 having ribbed walls, so that the ball is lifted up by the water, but without swaying sideways. The ball is preferably of an elastic material inflated by gas under pressure, so that if the ball should be damaged, it will collapse like a punctured balloon and can be flushed down the outlet without getting stuck.

In a second aspect of the invention, where the float is regulated for preventing gas, typically air, from being sucked into the gully and deteriorates the effect of the vacuum gully, the float is in a closed position when there is no need for draining.

In a first embodiment, the float is arranged for adjusting the through-put flow, about in the same way as throttling disks, while the gully head is provided with a roof, the height of which establishes a vacuum gully effect. In this embodiment, the roof height of the gully head is adjusted for each gully on the same surface, so that all the gullies are operating so long as possible as vacuum gullies, or for a given one under pressure, before air is sucked into one of the gullies connected together. The float then is used for throttling gullies starting to take in air, so that gullies becoming dry will not block other gullies from the loss of suction from an unbroken liquid column.

By using a central control unit, the performance of the gullies can be monitored, for possibly adjusting the roof height of the gully head in order to bring the draining capacity to a maximum.

In another embodiment, the float is arranged both to define the ceiling or roof height of the gully head and for controlling through flow, about in the same way as throttling disks. In this embodiment, the float is adjusted so that the gully stays as wide open as possible without taking in air, for in this way to drain as fast as possible. As the water level 212 is reduced, the float is adjusted downwards to a minimum height. Then, when the water amounts are so small that the pipes are not filled any longer, the outlet system can handle these small amounts of water as in a gravity flow system. In the case where the float is a ball, this will prevent air/gas from entering during the progress when gullies become empty of liquid.

The operation of gullies follows several phases, and an optimal control/adjusting of gullies involves a surveillance of changes or transfers.

In a first phase, there is nothing to drain, and gullies are preferably closed, both in the first and the second embodiment. In addition to protecting against ice building up, such a method will also prevent dust and particles from entering the outlet system, even at warmer seasons or global regions.

In a second phase, the outlet system works as a gravity flow system until the amounts of water are so great that they can fill the outlet pipes, in that the water level then will build up around the gullies. This transition can be registered by a sensor connected to a central unit or by measuring the build-up of water around the float. In this phase, it can be decided if a flushing operation should be carried out. This is performed by letting the water level build up to a defined height before then opening of the gullies. When the gullies are opened, the floats can be activated or controlled to a maximum opening before air is sucked into the gullies. This can be performed separately for each gully or in parallel, or in combination of such.

In a third phase, the water level is reduced so that air can enter into at least one gully. This can be registered by measuring the water level above the float or above the effective roof of the gully, or by registering the pressure reduction in the outlet pipe connected to the gully when an air bubble is taken in, or by registering an increasing number of air bubbles in an acoustic way, optically, or by other means.

The gullies are controlled either by choking or throttling by the float or by lowering the effective gully roof by use of the float, for maintaining an unbroken liquid column for the longest time possible. Ultimately, the gully can be completely closed.

Typically, the amount of water may rise, whereby gullies again open for taking down the entering water. This can be registered in the same way as described for the first phase. In such consecutive opening phases, it is probably not necessary to carry out flushings.

In a fourth phase, all the gullies have become dry and the water column is broken. This can happen due to a lack of water supply that causes air to enter the gullies from the outlet system, and it is then registered that the pressure reduction in the outlet system has vanished. In this phase, it may be an advantage that all the gullies are to be opened so that, in this way, they can take the last remains of water and then operate as gravity flow gullies. Such a phase can be time-controlled so that the gullies are closed and again are ready to start the process once more when it is estimated that all the water has dried away. Alternatively, the remaining amount of water can be registered by a separate sensor.

During an operation at a small water flow into the vacuum gully, it will behave approximately like an open gully, but when the water supply exceeds a certain level corresponding to the height of the gully head/air lock, so that the gully head will be beneath the water, air will no longer penetrate into the outlet system, only water, so there will be an unbroken column of water from the gully to the outlet. Then, it is desirable to use an adjustment process for control of the float. The pressure sensor detects that a suction is established, and the control unit send control signals to the actuator so that the float is raised and the openings or the through flow is increased. After a certain point, air will enter the gully and an air bubble is taken in. This is registered by the pressure gauge, which then sends a signal to the control unit which in turn sends control signals to the actuator so that the float is lowered and the opening for through flow becomes reduced until air is no longer drawn into the gully. When a proper adjustment is carried out, the position of the gully head and the float is locked. The plant or system is first regulated again for through flushing or pressure testing of the roof, possibly also other conditions calling for a new adjustment of that system.

When several gullies are connected together in manifold, the floats are controlled so that each gully on the same roof surface has the same under pressure, to ensure an optimal draining.

This ensures an optimal opening into the gully and reduces the demand for a housing part to prevent smaller extraneous elements being taken in, as such elements effectively will be sucked down, and the control provides that such elements will not function as embankments around the gully.

As the conditions change over time, such as if further extraneous matter enters and changes the conditions for the gully, it is desirable to repeat the process so that the amount of such matter will not build up over time, and so conditions are optimally maintained.

The control and adjustment process takes in air over a period during the adjustment, which is not favorable for an effective draining over this period. It is therefore desirable that not many gullies are adjusted at the same time. This can be done either by having the control unit centrally positioned and common for many or all gullies, in order to adjust one or a reduced number of gullies at the time. If each gully has its own local control unit, the amount of simultaneous adjustment can be reduced by having the adjustment process carried out with uneven intervals.

However, it is still an advantage to provide the gullies with a leaf grid to prevent larger objects like twigs from blocking the float, while smaller particles can be handled by the system itself.

There are also other situations calling for adjustment of the float.

On delivering a system or plant, it is often advantageous to bring a roof under pressure to see that the surfaces are fully tight, and can often be a requirement when taking over such system or plant. This can be done simply by using the present invention and adjust all the floats to a closed position and then to fill the roof surface with water, possibly to a water level of 100-150 mm over the roof surface and during a 24 hour period. This can be done during a rain period or by filling the roof up with water.

When a pressure test is carried out, and the roof is maintained under 100-150 mm of water, this is a good start for an initial adjustment or setting, so that the greatest possible number, and preferably all, of the gullies are emptied for water at about the same time, and then the position for each gully head and float is locked.

Such a pressure setting can verify not only that the roof is tight, but also, that it has a sufficient carrying capacity, that the outlet system has a capacity to handle a maximum load, and that outlet pipes are not cracking or in other ways not withstanding the load.

It is also advisable to flush the gullies and the draining or outlet pipes, to thereby remove undesired elements, sand and other material which can accumulate over time in gullies and outlet pipes. Especially where concrete tiles are used, smaller concrete particles can detach and build up a deposit. This can be remedied by holding the floats in a closed position until an approximately 60 mm water level is built up, and thereafter, opening the floats and, in this way, rapidly filling up the outlet system and flushing it clean. This avoids the necessity for an internal flushing and manual work, a great benefit.

With these methods for initial adjusting is that they are not in need of a manual calculation for each gully.

An embodiment of the invention is shown in FIG. 4*a* and FIG. 4*b*, and comprises a gully 200 or drain having a gully bottom 240 and over it, a housing part 300 comprising a gully head 400 in its turn comprising a float 420 controlled or activated by an actuator 422. The actuator adjusts the height of the float over the gully bottom.

The actuator is itself controlled, e.g., based upon registered values from a pressure sensor 424.

The gully is preferably equipped with a heating element 426 to ensure that the float is not freezing to the gully bottom when it is in a locked position. The float will be closed when the air temperature is below the freezing point to prevent the gully from radiating heat, and in that way, to prevent ice building up on the roof surface.

The zero point will vary with the external temperature. At very low temperatures like −30° C., the zero point will be close to the float if a heating element is not used.

Correspondingly, zero point will be positioned further away at −1° C. By using a heating element, the zero point will be moved upwards, with the float remaining in a region above the freezing point, which also prevents the flow from freezing to immobility (congelation). The heating element, if used, can be controlled either locally by use of a thermostat, or use of a central control unit 428.

In another embodiment, a new or existing full flow system can be provided with a float, by retrofitting. Then, the float takes care of hindering warm air ascending into the gully to create ice build-ups. When the gully is filled with water, the float is lifted and lets the water pass. In this embodiment, the full flow function is separate from the prevention of ice build-up.

In such an embodiment, the float will often remain so deep under the gully head that it is maintained in a frost free region. The float does not necessarily need to be controlled by an electric actuator, but instead, it may be sufficient that the buoyancy of the float is sufficient for lifting it when water is flowing in.

In those cases where there is no need for the extended draining capacity in a full flow system, it is possible to provide a gravity flow gully with such a float for the purpose of ensuring that warm air is not entering up in the gully to make the growth of ice blocks possible. When the gully is filled with water, the float is raised and lets the water pass.

In systems having such a passive float, it is possible to use a ball. In a further advantageous embodiment, the float is inflated and set under pressure. If the ball should be damaged, it will burst and deflate to a size where it can be flushed out through the outlet, preventing it from blocking the gully or outlet pipes.

Figure 7A:
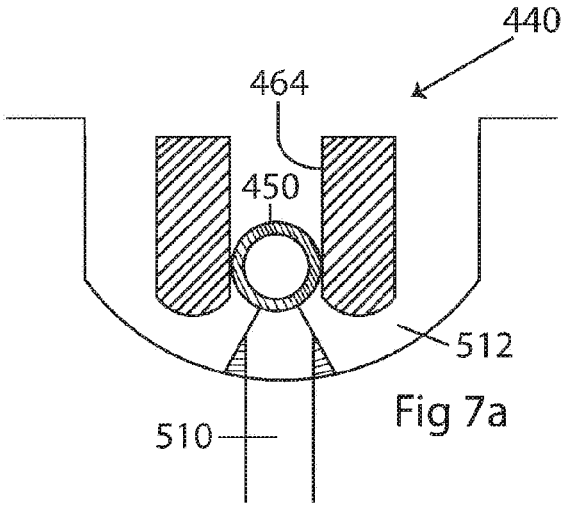
FIG. 7*a* shows a float system for a vacuum gully suitable for post-mounting in an existing gully system.
Figure 7C:
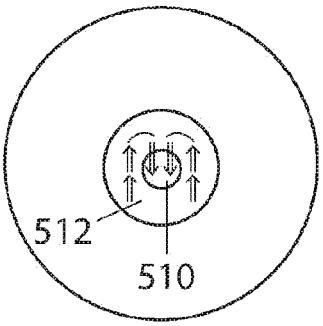
FIG. 7*c* shows the float system of FIG. 7*a* in an open position.
Figure 7B:
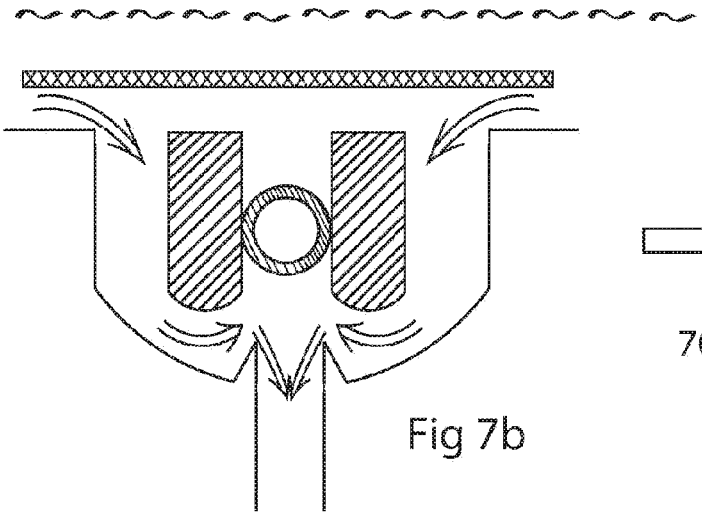
FIG. 7*b* shows the outlet and annulus of FIG. 7*a*, as seen from above.

For gullies, and in particular full flow systems, it is an advantage that the water flow from the gully is meeting the ball at mainly the same side as the outlet to the draining pipe, so that the water flow from the gully presses the ball away from the opening to the outlet or drainage pipe. In particular, by large flows, the force from the water may exceed the buoyancy of the ball and therefore lock it. If not, the force from the water acts in a direction mainly being the same as the buoyancy. This can be arranged in several different ways. A first embodiment is shown in FIG. 7*a*, where the water is fed from the gully into an annulus up against the ball while the outlet is surrounded by the annulus. FIG. 7*b* shows the outlet and annulus from above, where it is clearly presented that a liquid flow in the annulus will lift the float so that the liquid flow continues down into the outlet. While FIG. 7*a* illustrates the ball in a lower position where it closes the outlet, FIG. 7*c* shows the gully where water is flowing in and the ball is lifted up to an open position.

Figure 7D:
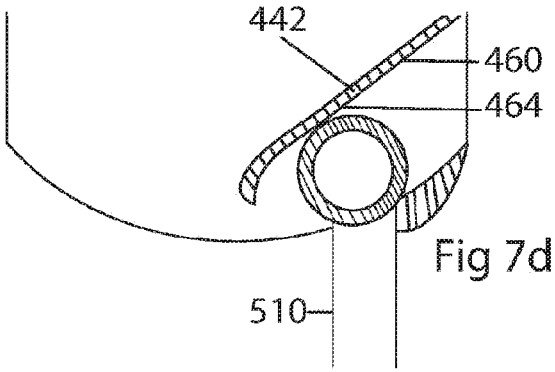
FIG. 7*d* shows an alternative to FIG. 7*a*, using a goose neck.

A second embodiment is shown in FIG. 7*d*, where the water is led through a goose neck 442 inclined upwards against the ball while the outlet is positioned adjacent the goose neck. In both situations, the ball is freely movable and positioned in a guide cylinder 464, preferably with a device for an upper limitation in the longitudinal direction, so that the ball is not lost.

These embodiments can be provided by post mounting in already existing gullies, or as an independent insert to be mounted into the outlet system some distance farther down, which is within the building. Typically, then one side of the insert can be disassembled for simple inspection and maintenance.

It is advisable to use a float control 460 to hold the float within a defined region so that it will not come out of position or be lost. In many cases, a dowel acting as a guide pin can be used to let the float slide along or off. In cases where a ball is used, preferably an inflated ball, it is practical to avoid puncturing, and then a guide cylinder 464 is shown to be a suitable means for holding the ball within a defined area.

It is an advantage that the gullies are arranged at the lowest parts of the surface to be drained, and separate sensors for detecting liquid height over the surface should also be arranged at the lowest parts on the surface.

It is also advantageous to have a central unit for a synchronized start of the adjustment of all the gullies, and for the control of the heating elements. By using a central unit, the gullies may be synchronized so that the adjustment of them can be done individually. In addition, a registration of the start of intake of air in one gully be used for adjusting all other gullies.

It is foreseen that a number of variations are possible over the above. As an example, the pressure gauge can be replaced by other means for registration that air is sucked into the gully, such as acoustical and/or optical sensor devices, and/or meters for through flow velocity. It is also possible that the control unit, the pressure gauge and the actuator are combined mechanically for the steering or control of the float. Alternatively, the float can be controlled to a constant water level over each float, preferred under 100 mm, more preferably 10-60 mm, and most preferably around 25 mm water. It is advisable not to build up too great a water pressure on roof surfaces to avoid water penetration through the roof construction and into the underlying building structure, and for avoiding overloading in extreme conditions.

It is an advantage if the control system of the gully is communicating wirelessly with the central control unit, so that the installation can be simplified. This, however, calls for an electric power source in the gully head. This can be accomplished by using a battery, and preferably a rechargeable battery to be charged by a solar panel arranged on the roof of the gully head.

A local power supply can also be provided by extracting energy from the liquid flowing through the gully.

The energy can be taken out from a separate turbine or propeller, or alternatively, the float can be provided with blades so that it rotates about the dowel pin. In both cases, the power typically can be fetched as a rotating movement of a rotor.

In a first embodiment, the energy can be purely mechanical, as the rotational speed of the rotor corresponds to the speed of the flow and then may give an indication of the liquid level 212 of the gully. A centrifugal regulator can be used for raising and lowering the float. If air should be drawn into the gully, this will reduce the rotational speed so that the gully is lowered. A mechanical pressure transmitter can also be used for regulating the float.

In another embodiment, the mechanical energy can be used for driving a simple generator for providing electric power to drive an electric actuator as well as electric pressure meters and control/steering units.

Gullies at several heights can be connected together to a common outlet system, as each roof surface then is individually adjusted by lowering and raising the floats. The connection to a main down pipe 525 should, however, be made correctly by letting each roof have its own gravity flow height before the connection. This is illustrated in FIG. 5*a*, in that the outlet from a lower roof is taken down along the outlet from an upper roof before the connection. This is made so as to let the lower roof establish certain under pressure to avoid water from the upper roof pressing up into the gullies of the lower roof and thereby making a fountain. If the system is used in a road system, each road level, if there are several, will operate in the same way as each individual roof level.

In the case where the float should freeze and become immovable, it is an advantage if it is made by a material having a thermal expansion coefficient that, together with its form, will make itself become detached from the ice. An example is that an expansion with the increasing number of degrees below zero combined with a concave form in a bowl will enable the float to be pressed up and out from the ice, and thereby be detached.

A float in the form of a ball will, in a conical gully, become pressed upward when the float expands. It is therefore an advantage if the control cylinder surrounding the ball has a conical form or part enabling the ball to be detached from ice at a temperature change.

A float designed for disintegrating and being flushed out when damaged can be provided with a transmitter for warning the system when the float remains are flushed out. The sensor can be arranged at the outlet or a manifold to limit the number of possible gullies from which the float has been lost.

The transmitter is, in a simple embodiment, a magnet, and the sensor can then be a magnetic sensor. In a system having a large number of gullies, it is an advantage to provide the floats with an identification, such as a radio frequency (RF) RFID-tag which, when its passes a RFID-reader arranged at the outlet, will identify the float remains being flushed out, so that it is possible to determine the precise gully that is now missing a float.

For gullies provided with a pressure sensor, it is easy to find which gully or gullies is/are missing a functioning float, as it/they then will not change the pressure during draining.

In an embodiment having a ball, a somewhat greater ball can be used to block the gullies by a manual pressure testing of roofs.

In an alternative embodiment a ball can be equipped with a mechanism releasing it at a higher water level than when necessary for lifting the ball alone under its own buoyancy. For example, the ball can be equipped with a magnet holding it in a closed position until the force of the buoyancy becomes so strong that the ball is released. In another example, the ball can be equipped with a locking mechanism that detaches the ball first at a minimum height of the water.

It is an advantage to keep foreign elements a sufficient distance from the gully in order to maintain the best and most unhindered flow into the gully.

Particularly advantageous is to avoid such unwanted elements acting in a way that the liquid level 212 of the gully is reduced too much.

It is found that a gully grid having arms like in a star is effective in this way.

Figure 8A:
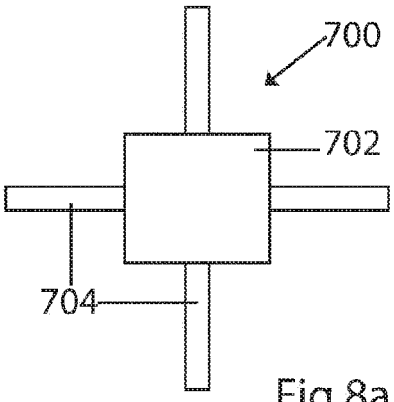
FIG. 8*a* shows a gully grid.

FIG. 8*a* shows such a gully grid 200 comprising a roof 702 in the gully grid, typically arranged above the gully. From the roof 702, arms 704 for the gully grid are extended. In a typical embodiment, four arms are used, but more or fewer arms can be used. The arms are provided with a grid at least at one of the roof, or a side or sides of the arms, where liquid is flowing into the arms in the gully grid and further to the proper gully.

Figure 8B:
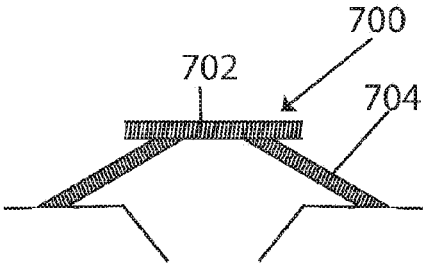
FIG. 8*b* shows a section of a gully grid.

FIG. 8*b* illustrates the gully grid 700 from its side, in a section. The arms are shown extending from the roof 700, and angled downwards and outwards against the roof 610, possibly the terrace 620. The illustration shows that the arms are connected near the middle of the roof 702, but it will also be natural to imagine that the arms are extending outwards like an extension of the roof.

In an advantageous embodiment, the arms are pointing downwards and are aligned or flush with the roof 610. This causes foreign bodies or particles to meet minimal resistance, and they will more easily slide upwards along the arms.

Larger foreign elements like, for example, twigs, will be captured on the arms, and if these elements are pressed inwards towards the gully itself, they will be lifted up and let liquid pass at the underside. Another problematic type of foreign element is leaves, as when a single leaf may pack around a traditional gully head and obstruct the openings into it. With a gully grid according to the invention, leaves will be guided along the arms and in towards the center, then into the corners between the arms.

This means that the outer portions of the arms are extending outside the amount of leaves and still may have a good capacity to handle the liquid.

The gully grid therefore is particularly suitable for a gully system according to the present invention.

If the roof is inclined, it may be sufficient to have one arm, arranged upstream of the gully. On a flat roof, it is an advantage to have two arms, but considerably more effective to have three arms.

In a further favorable embodiment, the arms 704 and roof 702 are arranged to avoid catching foreign elements, such as by using smooth surfaces and avoiding projections. This makes maintenance easier, and in particular on inclined roofs, the foreign elements will then gather at the lowest parts and not be stuck in a number of gullies.

During operation, a system according to the present invention will provide unbroken water columns a great deal of the time, as the floats can be continuously adjusted to keep a water height at, for example, 5 cm, as long as possible. This makes the system particularly well suited for leading into turbines. For smaller and lower buildings, the outlet pipe leads directly to the turbine that normally is positioned near the outlet or the transfer to the drainage network. For large and, in particular, tall buildings having vacuum gullies, it is common to operate with fall heights up to typically 15 meters before the vacuum system is interrupted, to avoid noise, vibration etc. If one wishes to drive a turbine, the roof water can be lead to one or several basins some floors under the roof surface. From these basins, the water throughput can be regulated further down in a way suitable for turbine operation. Use of a turbine has the advantage that a good deal of mechanical energy can be extracted from the water flow, so the force of the water coming out from the turbines in the bottom of the building is lessened.

In a further embodiment, gullies are provided with a motor valve.

During operation, the water level and temperature on the roof surface are measured.

When the temperature is below the water freezing point, the valve is nearly closed and will thereby nearly hinder air/heat from rising into the gully, but should there arrive some water drops, these will pass through. This hinders the water that can build up from the valve arranged internal in the building from rising up into the gully and there blocking the outlet with ice.

When the temperature on the roof surface is above the freezing point, the valve is opened and the gully is ready to take water. When the water sensor registers water higher than the air lock, that is, approximately 25 mm, the valve is adjusted so that the water level can be kept between, for example, 25-30 mm of each gully.

The invention finds its use by being employed in an effective draining of surfaces like roofs, parking areas, etc. More generally, it is found useful in two phase systems where a liquid component is to be removed without also taking a gas component, so even if the examples above are examples with air and water, these are just examples for an invention generally covering liquids and gases.

The invention is particularly useful where it is preferable to have effective draining, and where installed parts have to be as small as possible, such as on runways and roads.

The system is very suitable for upgrading older municipal surface water pipes by entering new pipes having smaller pipe dimensions into older pipes, replacing old basins with new ones, having special gullies as described and control for these also as described, so that the completely renovated outlet network will work as an UV system.

Even if the new pipe dimensions are smaller, these pipes will, in this way, be handling much more water.

The invention claimed is:

1. A gully system including a gully for draining a liquid to a drainage system, said gully system comprising:
- a float arranged so that the float and a portion of the gully define a closable opening for through flow, and
- arranged so that the float prevents gas from being drawn into the gully;
- wherein the gully system further comprises an actuator for controlling the float;
- means for controlling the float so that gas is not passing the float into the gully, said means comprising:
  - a sensor for detecting that gas is drawn into the gully, and
  - a control unit,
- wherein said means for controlling the float are arranged
  - to control the actuator for opening by way of the float until gas is drawn into the gully, and
  - to control the actuator for closing by using the float until gas is no longer drawn into the gully.

2. The gully system according to claim 1, wherein said sensor for detecting that gas is drawn into the gully is a pressure sensor situated downstream from the float.

3. The gully system according to claim 1, wherein said means for controlling the float are arranged near the gully.

4. The gully system according to claim 1, wherein said means for controlling the float are arranged for controlling more than one float.

5. The gully system according to claim 1, comprising a roof in a gully grid, and
- further comprising at least one arm extending outwardly and downwardly from the roof.

6. The gully system according to claim 5, wherein the at least one arm extends downwardly until it is in alignment with the roof.

7. A method for controlling a gully system according to claim 1, wherein the actuator is adjustable to:
- lift the float until gas is drawn into the gully, and
- lower the float until gas is no longer drawn into the gully.

8. A method for controlling a gully system including a gully for draining a liquid to a drainage system, the gully system including a float arranged so that the float and a portion of the gully define a closable opening for through flow, wherein the gully system further comprises an actuator, the method comprising:
- having the actuator control the float to prevent gas or heat from an outlet to rise up from the gully and forming ice;
- the actuator being adjustable to:

lift the float until gas is drawn into the gully;

detect that gas is drawn into the gully; and lower the float until gas is no longer drawn into the gully.

9. The method according to claim 8, further comprising repetition of steps for adjustability.

10. The method according to claim 8, further comprising repetition at unequal intervals of steps for adjustability.

11. The method according to claim 8, wherein the actuator is further used for flushing, wherein adjustability includes:

controlling the actuator to close by using the float until a liquid level above the gully has reached a critical height, and adjusting the actuator for opening by using the float so that the draining system is filled with liquid.

12. The method according to claim 11, wherein the critical height is 60 mm.

13. A method for controlling the gully system according to claim 8, wherein the float prevents gas from being drawn into the gully and the actuator is controlled to:

lift the float until gas is drawn into the gully, and lower the float until gas is no longer drawn into the gully.

* * * * *